United States Patent [19]

Cone

[11] 4,288,123

[45] Sep. 8, 1981

[54] HIGH CHAIR TRAY ATTACHMENT MECHANISM

[75] Inventor: Richard E. Cone, Dayton, Ohio

[73] Assignee: Questor Corporation, Toledo, Ohio

[21] Appl. No.: 83,796

[22] Filed: Oct. 11, 1979

[51] Int. Cl.[3] ..... A47B 39/00; A47B 39/04

[52] U.S. Cl. ..... 297/154; 297/162; 297/170

[58] Field of Search ..... 297/154, 155, 150, 170, 297/162, 149, 148

[56] References Cited

U.S. PATENT DOCUMENTS

| | | | |
|---|---|---|---|
| 1,003,245 | 9/1911 | Emmons | 297/154 X |
| 2,522,087 | 9/1950 | Boudreau | 297/150 |
| 3,212,814 | 10/1965 | Anderson | 297/155 |

FOREIGN PATENT DOCUMENTS

| | | | |
|---|---|---|---|
| 464806 | 4/1937 | United Kingdom | 297/149 |
| 721127 | 12/1954 | United Kingdom | 297/149 |

*Primary Examiner*—James T. McCall

*Attorney, Agent, or Firm*—John E. Benoit; Donald R. Bahr

[57] ABSTRACT

An attachment mechanism for use with a tray having an adjustable swinging bracket secured on the underside thereof and removably secured to one arm comprising a bracket secured to the underside of the tray in juxtaposition with the other arm and having depending legs forming a recess for the arm, a plate secured within the bracket and spring biased against said legs and having a pin extending into an aperture in said arm whereby said latch and said tray may be gripped with one hand so as to overcome said bias and remove said pin from said aperture.

4 Claims, 6 Drawing Figures

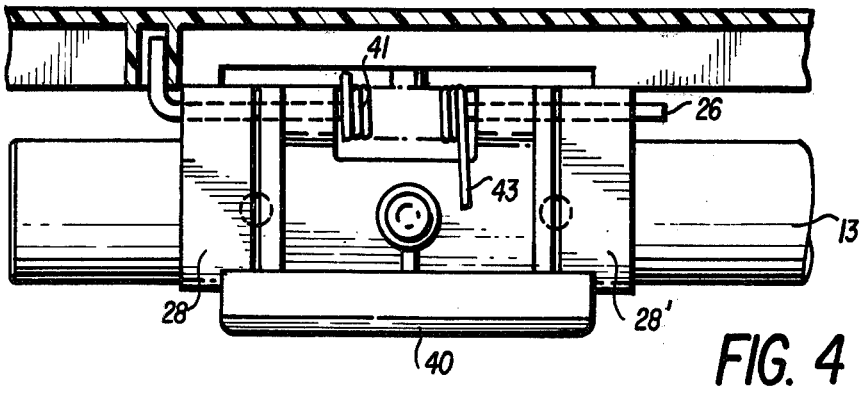
FIG. 4
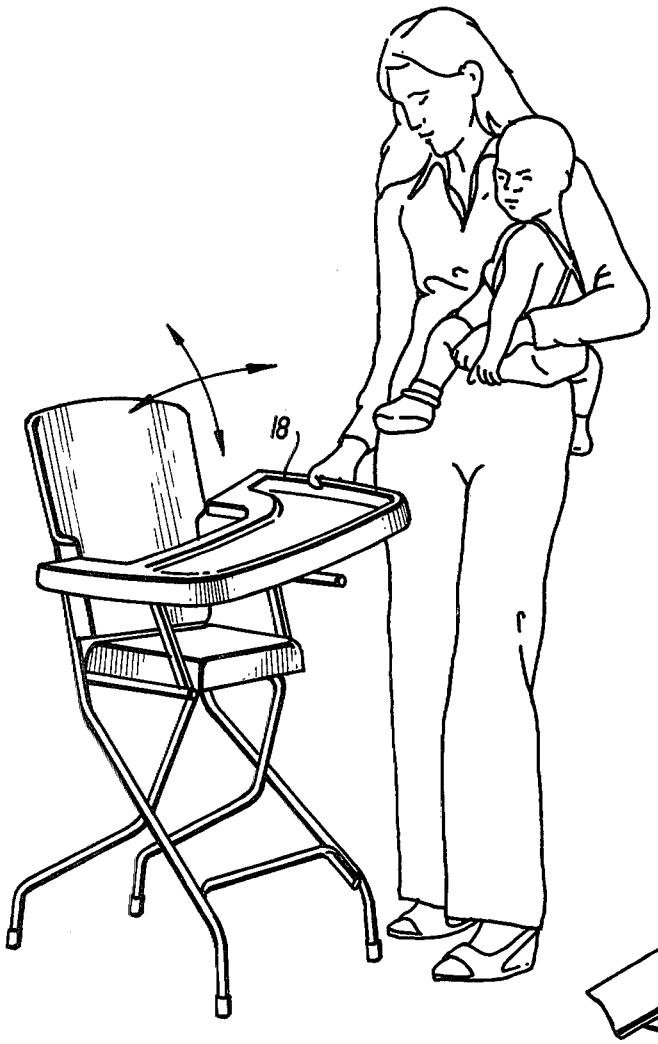
FIG. 6
FIG. 5
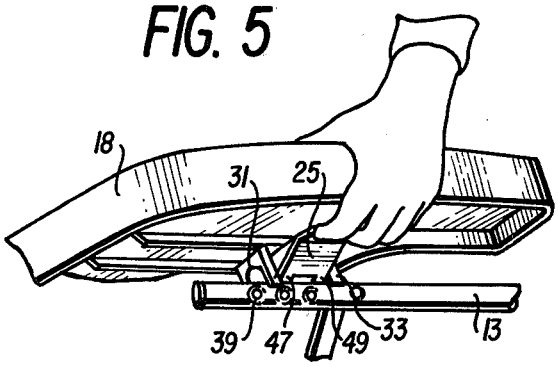

HIGH CHAIR TRAY ATTACHMENT MECHANISM

This invention relates generally to attachment mechanisms for high chair trays and more specifically to an attachment mechanism designed for use with a swivel type connection which allows the tray to be maintained on the high chair but in a position adjacent the side of the chair when it is not in use.

BACKGROUND OF THE INVENTION

The attachment mechanism of the present invention is designed for use with a swivel type of connection used with high chairs, one example of such mechanism being shown in U.S. Pat. No. 3,632,163 entitled "Adjustable Swinging Tray For High Chairs," issued Jan. 4, 1972. In that particular configuration, there is provided a tray having a detachable snap connection with respect to one arm and a removable and adjustable swivel connecting the tray to the other arm so that the tray is swingable in a compound manner on arcs having axes generally parallel to the arm to which it is secured and also on a axis at right angles thereto.

This type of mechanism is used in conjunction with other types of structures such as desks and the like wherein the same compound swinging mechanism allows the particular surface to be effectively stored adjacent the side of the chair and still ready for use when desired.

One of the problems arising when using this device with a tray for a high chair is that the mechanisms which have been used on the opposite side of the swivel require that the user have both hands free in order to release the tray from that side so that it may be lifted and swung into an inoperative position. This is the situation in connection with the above-identified patent. In that patent there is provided a latch which is released by pulling on a small button, and then lifting the tray while the button is held in its retracted position. without some extreme manipulation, this requires that both hands be used.

However, it has been determined that in many instances, when the person who is to manipulate the tray of the high chair wishes to place the tray in the operative position, that person quite often is holding a baby or small child in one arm and has only the use of one hand. This situation also exists when the baby is to be removed from the high chair and is held in position with one hand while the tray is being removed. Accordingly, it is an object of this invention to provide a swivel type tray for attachment to a high chair wherein the tray may be released from the arm opposite the swivel and easily lifted and rotated with one hand while the other hand is effectively immobilized.

It is a further object of this invention to provide a relatively simple latching mechanism which is spring biased into a lock position, but may be easily released from the lock positioned by exerting a force counter to the biased with only one hand.

These and other objects of the invention will become apparent from the following description when taken in conjunction with the drawings.

BRIEF DESCRIPTION OF THE DRAWINGS

FIG. 4 is a side view of the mechanism as shown in FIG. 2;

FIG. 5 is a partially broken away view showing the operation of the mechanism of the present invention; and FIG. 6 is an illustration of the use of the mechanism while having only one free hand.

BRIEF SUMMARY OF THE INVENTION

The present invention is designed for use in combination with the arms of a high chair, a tray, an a swivel mounted on the other side of said tray for removably securing the tray to one of said arms. The mechanism of the invention is used as a connection to one arm of the tray and is mounted to the underside of the tray. A bracket means is mounted on the underside of the tray in juxaposition with said arm and includes depending legs which extend downwardly from the bracket so as to form a recess for accepting the arm. The arm has at least one aperture through the outer wall, and a plate is rotatably mounted on the under side of said tray adjacent to the depending legs. Spring means rotatably bias the plate against the depending legs of the bracket and the arm of the chair. A pin extends from the plate and is of a dimension to mate with the aperture. A flange extends outwardly from said plate toward the outer edge of the tray so that movement of the flange, by placing the thumb. on the top of the tray and exerting pressure with the fingers on the flange, results in the release of the bias pressure created by the spring, and removal of the pin from the aperture. While the tray is thus being gripped it may be lifted and rotated so as to place the tray alongside the edge of the chair adjacent the swivel mechanism.

DETAILED DECRIPTION OF A PREFERRED EMBODIMENT OF THE INVENTION

Figure 1:
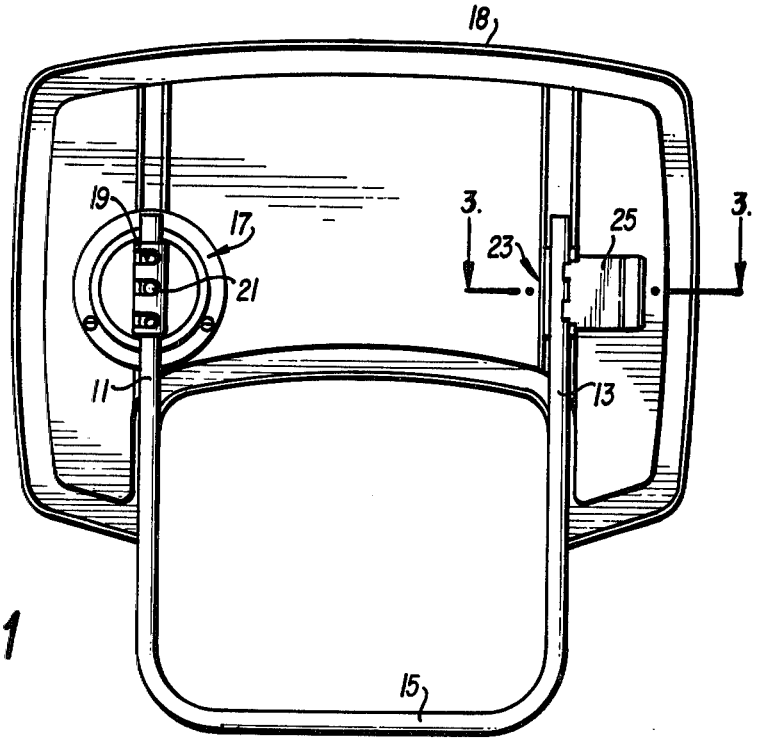
FIG. 1 is a bottom view of the tray being used with the invention and the associated attachment and swivel mechanism associated therewith.

Turning now to FIG. 1 there is shown therein arms 11 and 13 of a standard type chair (not shown). As is the usual custom, the two arms and bight section 15 form a U-shaped member which extends about the chair itself and forwardly thereof. FIG. 1 shows the under side of the tray wherein an adjustable swivel bracket 17, such as that shown in U.S. Pat. No. 3,632,163, is mounted to the tray 18 and is mated with a selected one of the apertures 19 in arm 11 by means of a spring pressed finger-retractable latch button 21. Since this particular swivel mechanism is not part of the present invention, reference is made to the above-identified patent for details of such a mechanism. However, it is apparent that depression of the spring pressed finger-retractable latch button 21 releases the tray so that it may be removed from arm 11.

Figure 2:
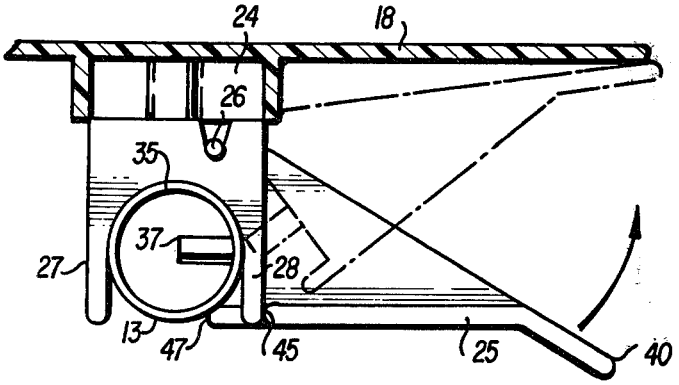
FIG. 2 is a partically broken away rear view of the mechanism of the present invention.
Figure 3:
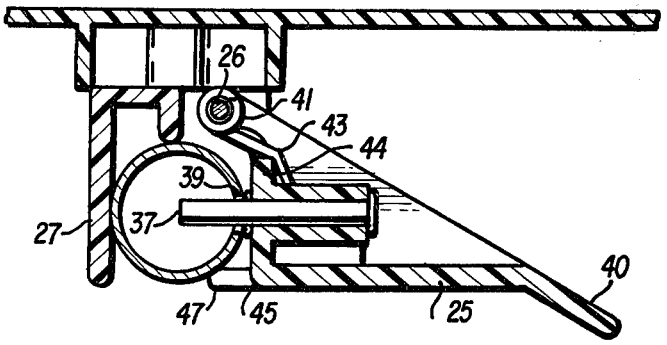
FIG. 3 is a cross sectional view taken through the lines 3—3 of FIG. 1.

The mechanism of the present invention will be discussed in detail in connection with FIGS. 1 through 4. It will be seen that bracket 24 of spring biased rotatable latch 23 is mounted on the underside of the tray by means such as screws or the like (not shown). Bracket 24 has subtending therefrom legs 27 and 28 which form a channel 35 within which leg 13 may rest as indicated in FIG. 2. It should be noted that, in the present construction, the bracket itself consists of two sets of legs spaced at a fixed distance as is evident from FIG. 4.

A plate 25 is mounted between the two sets of legs on pivot pin 26 so that it is rotatable clockwise and counterclockwise as indicated. A pin 37 is secured to the plate by means such as riveting so as to be secured therein. Pin 37 is of a dimension such that it may pass through the aperture 39 in the arm. In order to provide adjustment relative to the back of the chair, the same number of apertures are in arm 13 as are in arm 11 so as to maintain the tray evenly positioned on the chair. A coil spring 41 is mounted about the pin 26 and terminates at one end in a finger 43 which bears against a lip 44 on plate 25. This spring biases the plate in a clockwise direction so as to maintain pin 37 within aperture 39.

The above described construction where the axis of the pin is at substantially right angles to the axis of the arm and parallel to said tray provides a secure position latching mechanism. A flange 40 extends outwardly from plate 25 and is preferably angled as shown in the drawings.

With the structure described above, it is obvious that the latching mechanism associated with arm 13 may be released by moving flange 40 in an upward direction as indicated by the arrow in FIG. 2. This can be easily accomplished as shown in FIG. 5 by merely placing a thumb on top of the tray and grasping the flange 40 with the fingers and squeezing. This overcomes the bias of spring 41 and removes the pin 37 from aperture 39. While still maintaining the grip on the tray, it may be lifted so as to rotate it about the axis of arm 11 and then rotate it parallel to the axis of the arm so that the tray may be maintained in position alongside the chair. These two rotating motions are indicated by the arrows in FIG. 6. A figure of a mother and a baby are illustrated in FIG. 6 to indicate the ease with which the mechanism may be operated while still carrying a small child.

It is to be understood that the above description and drawings are exemplary only, and the invention is to be limited only by the scope of the following claims.

I claim

1. In combination with the arms of a high chair, a tray, and a swivel mounted on the underside of said tray and removably securable to one of said arms, the improvement comprising bracket means mounted on the underside of said tray in juxtaposition with said other arm;

depending legs extending downward from said bracket so as to form a recess for said other arm;

at least one aperture in the outer surface of said other arm;

a plate rotatably mounted on said underside of said tray adjacent said depending legs;

spring means for rotatably biasing said plate away from said underside of said tray and against said depending legs;

a pin extending from said plate and being of a dimension to mate with said aperture; and a flange extending outwardly from said plate toward the outer edge of said tray, whereby movement of said flange in a direction toward the underside of said tray overcomes the bias of said spring means and removes said pin from said aperture.

2. Apparatus for attaching a tray to the arm of a high chair comprising a swivel mounted on the underside of said tray;

a channel integral with said swivel of a size to permit passage of one of said arms;

means for releasably securing said one of said arms in said channel;

bracket means mounted on the underside of said tray in juxtaposition with said other arm;

depending legs extending downward from said bracket so as to form a recess for said other arm;

at least one aperture in the outer surface of said other arm;

a plate rotatably mounted on said underside of said tray adjacent said depending legs;

spring means for rotatably biasing said plate away from said underside of said tray and against said depending legs;

a pin extending from said plate and being of a dimension to mate with said aperture; and a flange extending outwardly from said plate toward the outer edge of said tray, whereby movement of said flange in a direction toward the underside of said tray overcomes the bias of said spring means and removes said pin from said aperture.

3. The apparatus of claim 2 wherein said flange extends from the outer end of said plate and away from the underside of said tray.

4. The apparatus of claim 2 wherein the axis of said pin is substantially perpendicular to the axis of said arm and substantially parallel to the plane of said tray.

* * * * *